United States Patent [19]

Levy

[11] 4,340,114

[45] Jul. 20, 1982

[54] CONTROLLED PERFORMANCE HEAT EXCHANGER FOR EVAPORATIVE AND CONDENSING PROCESSES

[75] Inventor: Marco Levy, Bal Harbor, Fla.

[73] Assignee: Lambda Energy Products, Inc., Bal Harbor, Fla.

[21] Appl. No.: 98,730

[22] Filed: Nov. 30, 1979

[51] Int. Cl.[3] ..... F28B 1/00

[52] U.S. Cl. ..... 165/110; 261/114 A; 261/152; 261/156; 62/525; 165/166

[58] Field of Search ..... 165/103, 110, 107, 116, 165/117; 159/20 R; 261/114 A, 152, 156; 62/526, 527, 491

[56] References Cited

U.S. PATENT DOCUMENTS

| | | | |
|---|---|---|---|
| 1,904,380 | 4/1933 | Morrell et al. | 261/114 A |
| 2,231,856 | 2/1941 | Wetter | 165/117 X |
| 2,708,832 | 5/1955 | McGregor | 165/110 |
| 3,468,022 | 9/1969 | Fischer | 165/182 |
| 3,805,546 | 4/1974 | Lenning | 261/114 A |

*Primary Examiner*—Samuel Scott
*Assistant Examiner*—Theophil W. Streule, Jr.
*Attorney, Agent, or Firm*—B. P. Fishburne, Jr.

[57] ABSTRACT

An essentially tubeless heat exchange structure and an attendant controlled evaporative or condensing process is disclosed. A finned heat exchanger body has multiple spaced through passages constructed by locally deforming the fin metal. Each through passage includes multiple terraced liquid traps and coaxial orifices for counterflowing gas. A liquid supply device and gas pressure relief device is provided for each through passage. The physical construction of the finned heat exchanger body can vary widely depending upon application.

4 Claims, 15 Drawing Figures

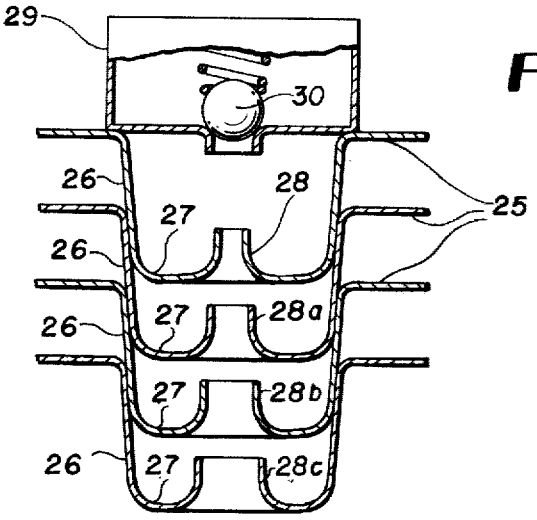
FIG. 4
FIG. 5
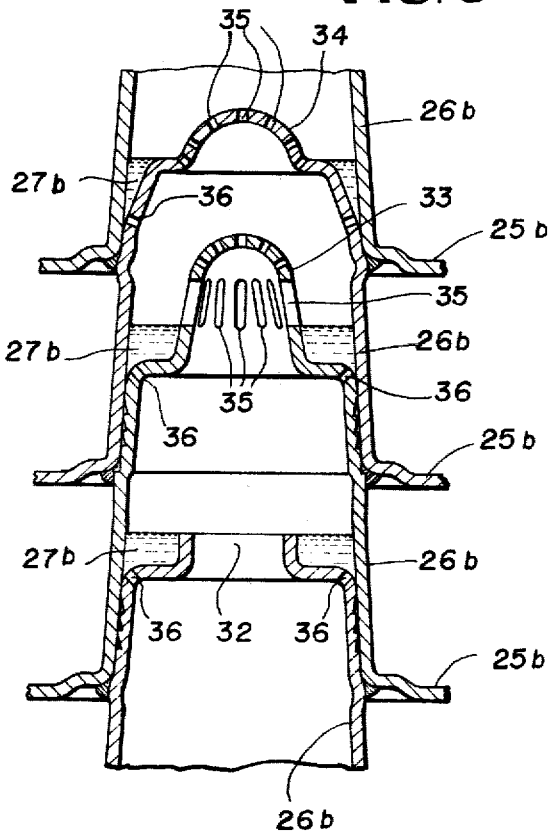
FIG. 6
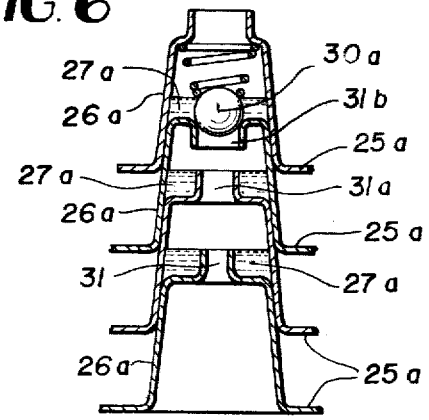
FIG. 7
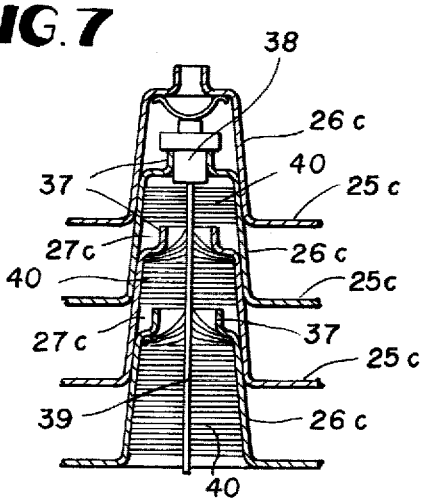
FIG. 8
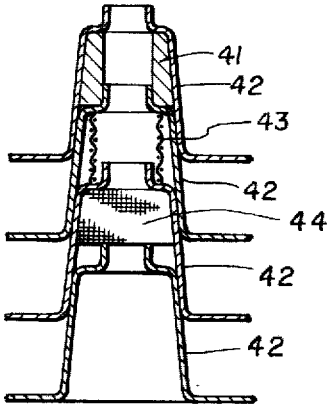

FIG. 9
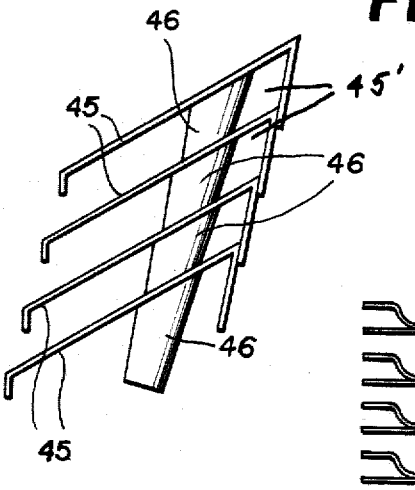
FIG. 10
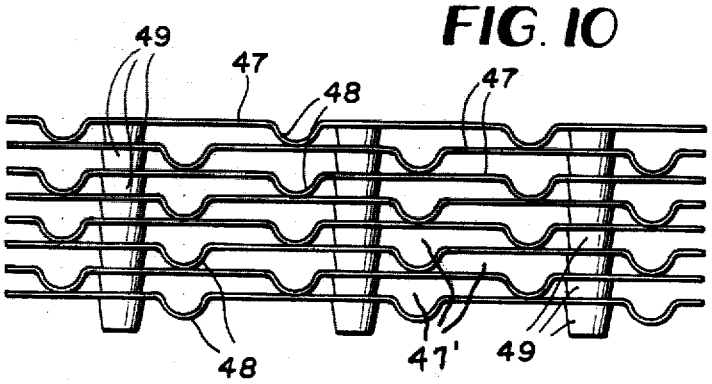
FIG. 11
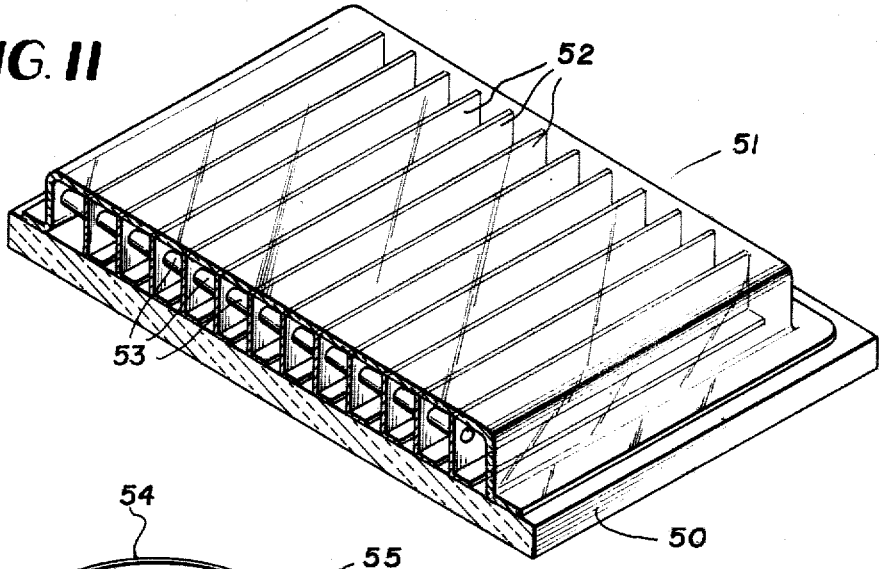
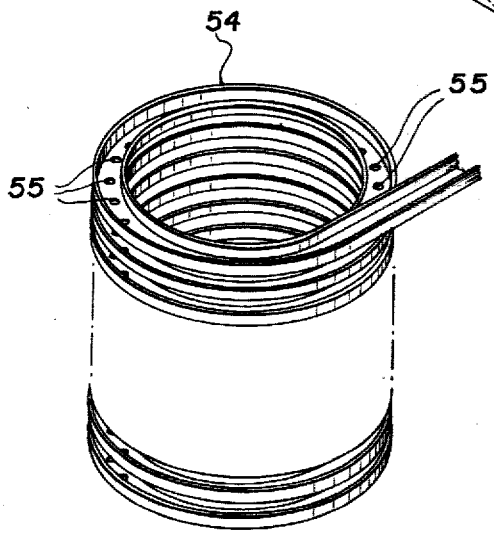
FIG. 12

FIG. 13
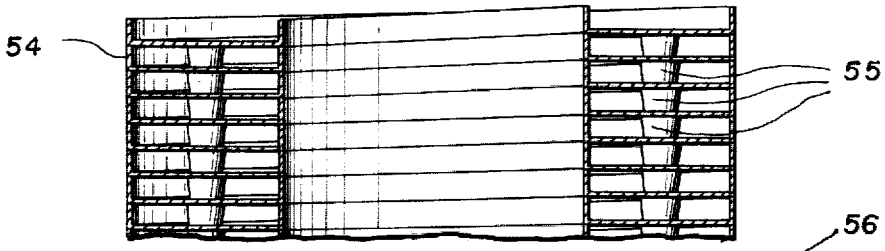
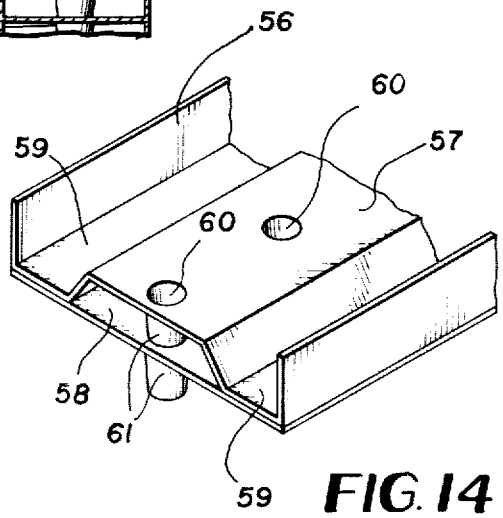
FIG. 14
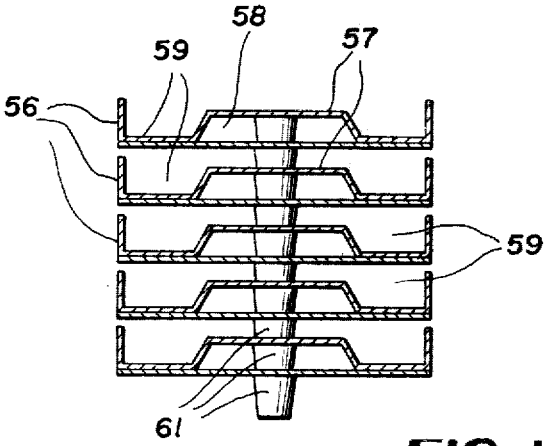
FIG. 15

CONTROLLED PERFORMANCE HEAT EXCHANGER FOR EVAPORATIVE AND CONDENSING PROCESSES

BACKGROUND OF THE INVENTION

Prior art heat exchangers and evaporative processes as employed for refrigeration and the like have recognized drawbacks which thus far have defied correction. Evaporators for refrigeration systems, air conditioning and other uses commonly employ an interior liquid running in a conduit whose walls transfer heat to the running liquid from an exterior fluid which may be gas or liquid requiring cooling. The interior liquid within the conduit undergoes evaporation and continually is converted into a gas. Until this conversion is complete, the interior running fluid is a gas and liquid mixture. The percentage of gas in the mixture increases until the interior fluid is all gas and no liquid and the evaporative process is completed.

In this gradual evaporative process, a gas bubble film tends to develop on the interior surface of the conduit for the running liquid and this film greatly hinders the transfer of heat through the wall of the conduit or tube to the liquid internally of the gas bubble film. In order to minimize this hinderance to efficient heat transfer, the interior running mixture must be propelled with a turbulent velocity to break up the gas bubble film in order to increase heat transfer efficiency. This, in turn, requires a greater consumption of energy.

Additionally, as the percentage of gas in the interior running fluid increases, the heat transfer hinderance factor correspondingly increases. For example, when the mixture becomes 60% gas and 40% liquid, the heat transfer rate in that part of the conduit drops to 40%, and in the area where the mixture is 90% gas and 10% liquid, the heat transfer rate drops to only 10%. Since a constant size tube or conduit is ordinarily employed in an evaporator, the average heat transfer rate all along the conduit is only about 50% of the true capacity of the heat exchanger or evaporator.

To increase the velocity and turbulence of the interior running fluid mixture not only consumes energy but increases internal friction which heats up the inside liquid. This obviously further decreases the ability of the system to transfer heat from the exterior fluid to the interior fluid. To cope with these two disadvantages, the heat transfer area (tube size) must be increased to increase the volume of internal liquid. It is also necessary to increase the energy of devices necessary for the removal of the interior liquid. In practice, a virtual dilemna is created. Because the exterior fluid such as air also has zones of unequal temperatures, the heat exchanger must simultaneously cope with unequal heat loads in different areas. This makes it impossible to choose a single efficient internal running fluid gas-liquid ratio. It follows from this that if a heavily heat loaded area of the exchanger would be cooled by a weakened liquid mixture, say 80% gas and 20% liquid, then, according to the above-explained process, the weakened liquid mixture and the lowest heat transfer capacity area will be asked to satisfy the heaviest heat transfer requirement which will be an impossibility. This phenomena compels the use of oversized heat exchanger components (a waste of material) and the maintenance of increased internal and external turbulent fluid flow (a waste of energy).

In addition to all of this, there is another inherent disadvantage in conventional heat exchangers concerning the interior working pressure determining temperature of evaporation of the liquid which is critical to system design. If the interior heat load rises, the inside liquid evaporating temperature also rises. As a consequence, the temperature differential between the interior and exterior fluids is diminished and this also requires additional enlargement of the heat transfer wall sides to meet requirements. The resulting over-dimensioning of the heat exchanger structure is wasteful of metal and labor.

SUMMARY OF THE INVENTION

To overcome the above-discussed inherent drawbacks of the prior art and to provide a heat exchanger structure and an evaporative process of increased efficiency and economy, the present invention offers the following, briefly stated. The finned or baffled heat exchanger body is constructed to provide therein multiple rather closely spaced through passages constructed from interfitting contiguous deformed areas of the fins. Each such through passage contains multiple tiered liquid traps and coaxial gas orifices surrounded by the liquid traps. The gas and liquid within each passage flow in opposite directions through the heat exchanger body. The liquid is admitted into each passage independently by a control valve or other device located at the entrance of the passage. Before entry, the liquid will have substantially zero gas content to prevent the discussed hinderance to heat transfer caused by gas bubbles at the start of the process. To prevent internal fluid friction and consequent harmful heating of the internal liquid, the latter enters each through passage of the exchanger at very low velocity. The arrangement permits continuous evacuation of gas in one direction and continuous liquid supply to empty liquid traps of each through passage in the opposite direction, as where certain traps have had their liquid converted into gas through evaporation. At the entrance of each through passage, a pressure-responsive device will control the flow of gas and will open when a certain gas pressure is reached. The liquid in counter-flow relationship to the gas will be admitted to each passage only when the gas pressure responsive control device is open. This control device is commonly some sort-of valve, or a gas flow restrictor.

The invention possesses the following advantages among others:

1. It allows opposite coaxial flow directions in each passage of the heat exchanger between gas and liquid.

2. It allows quick and efficient gas evacuation from the liquid because liquid evaporation takes place in a large number of shallow traps or troughs along each through passage.

3. The invention makes it feasible to maintain independently in each through passage the most desirable evaporative temperature; and this is obtained by the gas pressure valve in the entrance of each passage which releases gas immediately at a pressure corresponding to the ideal evaporative temperature.

4. It allows precision liquid supply only into required areas of the heat exchanger, and the liquid is supplied to the entrance of particular passages when the valve opens to let the gas out of the particular passage. It permits the delivery of liquid only into particular zones of particular passages where liquid has evaporated from a trap or traps. The empty traps will be efficiently refilled in the controlled evaporation procedure.

5. The invention permits when required the desired reduction in pressure of outgoing gas in each passage. This can be accomplished by valving and/or by regulation of gas flow orifice size at each terrace or level of each passage. Gas bubble removal from each passage can be enhanced by the action of a brush or hammering means in each passage.

6. The invention enables the control of evaporation and of heat exchange capability to respond to hot spots in a three dimensional pattern which has never been possible previously.

Other features and advantages of the invention will become apparent during the course of the following description.

BRIEF DESCRIPTION OF THE DRAWINGS

FIG. 4 is an enlarged fragmentary vertical section showing a portion of one through passage in the heat exchanger shown in FIG. 3.

FIGS. 5 through 8 are similar views showing modifications of the passage structures and gas discharge control means.

FIGS. 9 through 15 are fragmentary views showing modified heat exchanger structures according to the invention adaptable to particular applications or uses.

DETAILED DESCRIPTION

Figure 1:
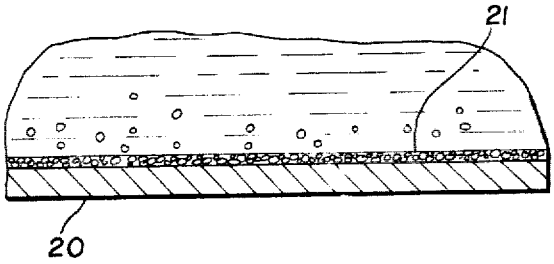
FIG. 1 PRIOR ART
FIG. 1 is a fragmentary cross sectional view taken through the wall of a prior art heat exchanger conduit showing the heat transfer hinderance caused by the gas bubble film.
Figure 2:
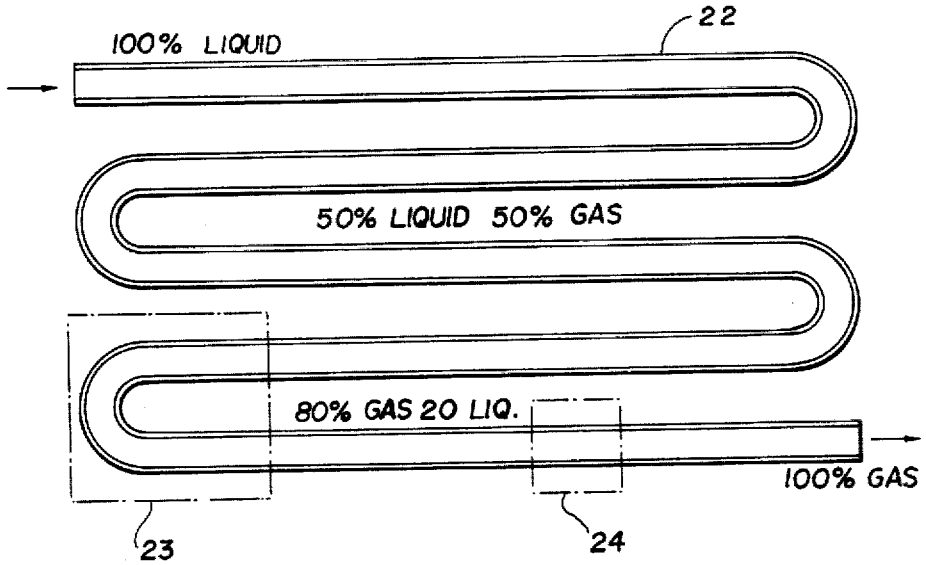
FIG. 2 PRIOR ART
FIG. 2 is a schematic view showing the traditional evaporative process in a heat exchange conduit such as a refrigerant evaporator according to the prior art.

Referring to the drawings in detail wherein like numerals designate like parts, FIGS. 1 and 2 depict schematically the deficiencies of the prior art discussed previously in some detail, which deficiencies the present invention seeks to eliminate substantially. FIG. 1, on a very enlarged scale, shows a wall fragment 20 of a heat exchanger tube having a fluid medium running therethrough such as any well known refrigerant. The tube 20, for example, may be a portion of a refrigeration evaporator structure. As explained previously, a film 21 of gas bubbles tends to develop over the interior surface of the metal wall 20 hindering the transfer of heat from the exterior fluid, such as ambient air, to the interior fluid in the tube 20.

FIG. 2 depicts schematically the gradual phase change occurring in a refrigerant running through an evaporator coil or in another type of heat exchanger having an internal fluid to receive heat from an external fluid through the metal wall of the coil 22 which has a constant cross section throughout its length. At the start of the heat exchange cycle or refrigeration cycle, the internal fluid is completely liquid; near the middle of the cycle and the middle of the coil 22 the internal fluid has picked up heat and is half liquid and half gas. Near the end of the heat exchanger coil and cycle, the internal fluid is predominantly gas and at the end of the coil and cycle, it is completely gas. If the numerals 23 and 24 represent areas of the heaviest heat loading, it will be appreciated that the system is being required to transfer the greatest amounts of heat from one fluid medium to another in the area where the weakened internal liquid mixture has the lowest heat transfer capacity. This is the situation which exists in the prior art as was fully described previously and this is the situation which is corrected by the present apparatus and method.

Figure 3:
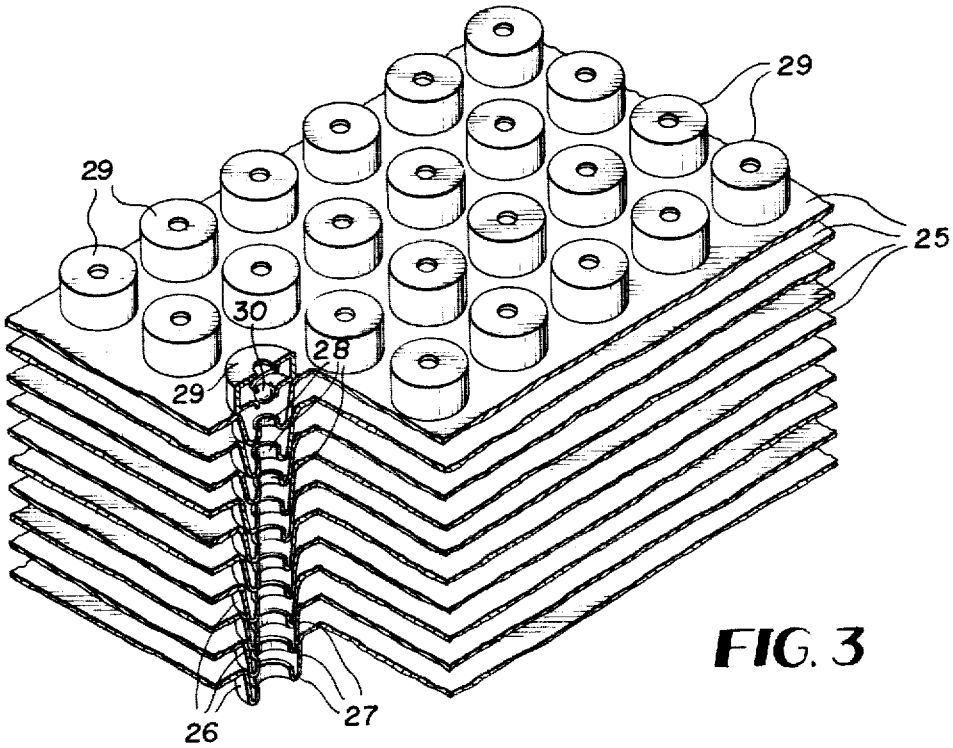
FIG. 3 is a fragmentary perspective view of a controlled performance heat exchanger according to the invention.

Referring to FIG. 3 showing one possible embodiment of the invention, a heat exchanger such as a refrigeration evaporator unit, radiator structure or a similar device, comprises a plurality of equidistantly spaced parallel flat metal plates or fins 25 of any required size and shape to satisfy particular needs. The metal plates 25, as best shown in FIG. 4, are individually deformed at spaced intervals to produce thereon a multiplicity of depressed somewhat conically tapered cup-like extensions 26 adapted to nest or telescope coaxially and to be anchored together by bonding, soldering or mechanically. the arrangement of the interfitting extensions 26 forms multiple parallel closely spaced columns through the heat exchanger perpendicular to the plates 25 thereof to produce a strong integral structure.

Each extension 25 includes a shallow annular liquid trap 27 at its bottom surrounding a central axial gas flow aperture means or nozzle 28, **28*a*, 28*b*, 28*c*, etc. These nozzles are graduated in diameter and decrease progressively in size between the opposite sides of the heat exchanger defined by the plates 25. In appropriate cases, the nozzles may increase in size rather than decrease in the same direction illustrated in FIG. 4. The nozzles 28, 28*a*, 28*b*, 28*c*, etc. can be seen to form a gas through passage completely through the heat exchanger at the axial center of each column formed by the attached interfitting cup-like extensions 26. Within each such column, a plurality of the liquid traps 28** in tiered relationship surround the gas nozzles and the axial through passages produced thereby.

As shown in FIGS. 3 and 4, at the top of each column formed by the extensions 26 is a liquid admission unit 29 through which an internal liquid, such as a refrigerant, completely free of gas, is introduced into the entrance of each column of the heat exchanger. In the bottom of each admission unit 29 is a gas pressure responsive spring-urged ball check valve 30 or equivalent means releasably closing the outlet orifice of the unit 29. This valve 30 is also a pressure-responsive outlet valve for gas flowing upwardly in the column through nozzles 28, **28*a*, 28*b*, etc. During operation, liquid metered into each column by one device 29 at each opening of the valve 30 flows downwardly in small amounts and enters the traps 27 to be held thereby. Gas is simultaneously flowing upwardly or counter to the liquid flow in each gas passage defined by coaxial nozzles 28, 28*a*, 28*b*, etc. The gas outlet valves 30 open in response to a predetermined gas pressure to release the gas from each column and the counter-flowing liquid can enter that particular column only when the valve 30** is open, as will be further discussed.

Over the entire heat exchanger containing a multitude of the described columns, the operation of each column is independent from every other column of the system to enable the system to operate most efficiently for transferring heat in response to local hot spots or comparatively cooler spots which may exist over the area of the heat exchanger. It will of course be understood that an exterior fluid, such as ambient air in an air conditioner or the like, is flowing between the spaced plates 25 externally of the columns made up of the extensions 26. Heat contained in this external fluid is continuously transferred through the plates 25 and the walls of the extensions 26 to the internal fluid in liquid form contained at all times in small amounts in the tiered traps 27. This arrangement produces a closely controlled evaporation of liquid in the multiple columns of the heat exchanger in terms of local thermal conditions existing across the entire heat exchanger, ranging from very hot spots to comparative cool spots. Even within the individual columns of the heat exchanger, the system can operate with maximum efficiency and respond to localized thermal conditions within that particular column. For example, if a hot spot exists near the axial center of one column, the liquid in one or two of the traps 27 may be entirely evaporated at those points only and not in the traps 27 above and below. The conversion of this localized liquid in the gas running through the nozzles 28, 28*a*, 28*b*, etc. can elevate the gas pressure sufficiently to open the valve 30 and admit enough liquid from the adjacent device 29 to refill the one or two empty traps 27 of that particular column with vaporizable liquid. Simultaneously, this same independent mode of operation can take place in every column throughout the entire heat exchanger to produce a truly regulated evaporative process and a truly controlled performance heat exchanger in a three dimensional sense. That is, controlled liquid vaporization and controlled transfer of heat between an exterior and an interior fluid can take place differentially over the area of the heat exchanger spanned by the plates 25 and over the thickness thereof defined by the columns consisting of the engaged extensions 26. It can be seen that the described construction and mode of operation brought about by the invention completely eliminates the inherent drawbacks of the prior art discussed previously and illustrated in FIGS. 1 and 2. Because the system throughout contains only separated and isolated small volumes of liquid in the traps 27 instead of one continuous flowing mass of liquid, the tendency for films of gas bubbles hindering heat transfer to develop is greatly minimized or eliminated, and any bubbles which do develop are quickly carried off in the gas stream running through the nozzles 28, 28*a*, 28*b*, etc.

FIGS. 5 through 8 show variations in the construction of the liquid trapping and counter-flow gas discharging columns in the heat exchanger which can be substituted for the satisfactory arrangement shown in FIGS. 3 and 4.

For example, in FIG. 6, heat exchanger plates 25*a* have formed integral tapered telescoping cups 26*a* extending oppositely to the cups 26 and including central gas flow apertures 31, 31*a*, 31*b*, etc. which are graduated in size oppositely in comparison to nozzles 28, 28*a*, 28*b*, etc. Liquid traps 27*a* similar to the traps 27 are formed by the side walls of cups 26*a* and the nozzles forming the graduated apertures 31, 31*a*, 31*b*, etc. which they surround. A pressure responsive gas discharge control valve 39*a* similar to the valve 30 is provided for the endmost gas flow aperture 31*b*. In FIG. 6, as in FIG. 4, the gas flow is upward against the valve 30*a* and liquid flow is downward into the traps 27*a* only when the valve 30*a* is unseated. The overall mode of operation is unchanged from that described relative to FIGS. 3 and 4.

FIG. 5 shows another construction for each column of the heat exchanger wherein the ball check valve at the entrance to the column may be eliminated without any significant change in beneficial mode of operation. In FIG. 5, plates 25*b* have formed thereon interfitting cup-like extensions 26*b* which are secured in assembled relationship. Small liquid traps 27*b* are formed as shown, and all but the uppermost elements 26*b* have central gas discharge nozzles 32. The uppermost one or two extensions 26*b* in lieu of a ball check valve have domes 33 and 34 having multiple restricted gas slots 35 through which the flowing gas in each column can be discharged gradually under pressure. The counter-flow liquid component flows down the inner wall surfaces of the elements 26*b* into the respective liquid traps 27*b* and from each such trap flows through small ports 36 and into the next lowermost trap by continuing to run down the side walls of the elements 26*b*. It can be seen that the three dimensional control of performance of a heat exchanger and the three dimensional control of evaporation of an internal liquid can be achieved through the invention in a highly refined way by varying the gas flow passages locally within each column of the system in a manner similar to what is shownn in FIG. 5. That is to say, other elements 26*b* below the top two can have differently designed flow restrictors in any sequence desired to cope with localized conditions in the exterior or ambient fluid.

FIG. 7 shows a further variation in heat exchanger column design, wherein plates 25*c* having interfitting tapered cup-like extensions 26*c*, liquid traps 27*c* and gas flow nozzles 37 make up a heat exchanger. A spring-urged plug type gas flow control valve 38 carriers a depending attached stem 39 having brush sections 40 radiating therefrom in the chambers formed by the interfitting elements 26*c*. These brush sections continually clean the internal surfaces of the elements 26*c* and they also retard the formation of gas bubble films on the heat transfer walls of the columns of the heat exchanger.

FIG. 8 shows yet another variation in the heat exchanger column structure where metallic sponge 41 or the like may be placed inside of one column extension element 42 and a metallic screen element 43 inside of the heat lowermost element 42, followed by a woven sponge 44 in the next lowermost element 42 of the column. The arrangement of these elements in individual columns and in adjacent columns of the heat exchanger can be varied to achieve the desired controlled performance in a particular situation.

In addition to the heat exchanger structures illustrated in FIGS. 3 through 8, the shaping of the heat exchanger fins or plates can be widely varied to suit particular needs and applications within the capability of the invention which are many and varied.

For example, when used for collecting solar heat, FIG. 9, the exchanger plates 45 may be constructed as parallel inclined downwardly flanged channels capable of trapping heated air beneath them in the several still air pockets 45' formed by the channels 45 surrounding the interfitting tapered cup-like extensions 46 forming columns throughout the heat exchanger in the same manner shown in FIGS. 3 through 8 and for the same general purpose.

Similarly, in FIG. 10, for utilizing solar heat in a horizontal collector, stacked plates 47 have depressed corrugations 48 forming multiple still air heat traps 47' surrounding the several columns formed through the structure by interfitting tapered elements 49. In all cases, the columns conduct an internal fluid to which heat is transferred through the metal walls from an external fluid, as described in connection with FIGS. 3 through 8.

FIG. 11 shows another important embodiment of the heat exchanger in the form of a solar collector having an insulating base 50 and a transparent or translucent cover panel 51 suitably anchored thereto. Between the base 50 and cover panel 51 are placed plural equidistantly spaced parallel fins 52 also serving as support ribs for the cover panel 51 and allowing evacuation of the air trapping spaces beneath the cover panel for much greater thermal efficiency. The several fins or ribs 52 prevent the cover panel 51 from collapsing under the effect of the applied vacuum. The ribs 52 are joined at multiple points along their lengths by columns of sleeve elements 53 forming continuous fluid passages through the heat exchanger as described previously in the application, in FIGS. 3 through 8 for example.

Another variant of the structure is shown in FIGS. 12 and 13. A cylindrical tubular heat exchanger is constructed from a helically coiled channel member 54, the individual convolutions of which are stacked as shown in FIG. 13 and joined by interfitting tapered cup extensions 55 forming fluid passage means of any of the types shown in FIGS. 3 through 8. A liquid running through the helical trough of the coiled structure can be the exterior fluid in heat exchange relationship with the internal fluid running inside of connected elements 55. Three fluids, such as an external liquid and internal liquid and gas components, can be employed in the arrangement of FIGS. 12 and 13.

FIGS. 14 and 15 show a modification of the device in FIGS. 12 and 13, where, instead of a helically coiled trough 54, a straight trough 56 or pan is employed having a raised central tunnel element 57 mounted thereon forming a tunnel passage 58 for one fluid. A second fluid, namely a liquid, runs in the troughs or channels 59. A third fluid, such as a liquid-gas mix, runs in the passages of columns 60 formed by interfitting elements 61 exactly as described for the arrangements in FIGS. 3 through 8. FIG. 15 shows how the straight pans 56 may be stacked and joined in a multi-tier heat exchanger.

Throughout this application, the heat exchanger structure has been discussed primarily with relation to the evaporative process. It should be recognized that the same structure is equally suited for the condensing process which is the reciprocal of evaporation. When employed in the condensing process, care must be exercised to promptly evacuate the condensing liquid as by means of the several drain openings 36 in the embodiment shown in FIG. 5 where gas is rising upwardly through nozzle 32 and restricting slots 35 in the condensing process. The restricting slots 35, like the nozzles 28 through 28c in FIG. 4, or 40 through 44 in FIGS. 7 and 8, have the task of diminishing mechanically the gas energy content. In this way, the condensing capacity of the heat exchanger structure is perfected. Similarly, in the evaporating process, the compressor's work and energy demands are facilitated.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A heat exchanger structure particularly adapted for liquid-to-gas heat transfer comprising a multiplicity of spaced parallel heat transfer plates in fixed relationship and being in thermal contact with an external fluid medium, a multiplicity of spaced parallel axis tapered telescopically interfitting cup-like elements formed integrally on said plates and projecting from corresponding surfaces of the plates in coaxial relationship to form fixed parallel columns through the plates at right angles to the planes occupied by the plates and across the spaces between the plates, whereby such spaces surround the columns formed by the cup-like elements, coaxial spaced nozzle elements integral with the cup-like elements and projecting therefrom coaxially in spaced relationship and in one direction to form through the centers of said columns gas flow passages which are isolated from the spaces between said plates, portions of the cup-like elements surrounding said nozzle elements forming liquid traps in the columns, and gas pressure responsive liquid delivery means at one end of each column operable to deliver liquid into the columns in counter-flow relationship to the gas flow therethrough, whereby small amounts of the liquid can enter said traps and be held therein.

2. A heat exchanger structure as defined in claim 1, and said delivery means at one end of each column comprising a liquid container having an outlet coaxial with and opposing said nozzle elements, and a resiliently biased closure valve element for said outlet which opens in response to gas flow through each column at a predetermined pressure.

3. A heat exchanger structure as defined in claim 1, and said nozzle elements being graduated in size along the axis of each column with the smallest nozzle element nearest said liquid delivery means and the largest nozzle element remote from said means.

4. A heat exchanger structure as defined in claim 2, and said nozzle elements being graduated in size along the axis of each column with the smallest nozzle element nearest said liquid container and the largest nozzle element remote from said liquid container.

* * * * *